US012478115B2

(12) United States Patent
Smith

(10) Patent No.: US 12,478,115 B2
(45) Date of Patent: Nov. 25, 2025

(54) BATH ROBE TOWEL DEVICE

(71) Applicant: Claire Smith, Wausau, WI (US)

(72) Inventor: Claire Smith, Wausau, WI (US)

( * ) Notice: Subject to any disclaimer, the term of this patent is extended or adjusted under 35 U.S.C. 154(b) by 80 days.

(21) Appl. No.: 18/351,094

(22) Filed: Jul. 12, 2023

(65) Prior Publication Data

US 2024/0260684 A1 Aug. 8, 2024

Related U.S. Application Data

(60) Provisional application No. 63/444,075, filed on Feb. 8, 2023.

(51) Int. Cl.
*A41D 7/00* (2006.01)
*A47K 10/02* (2006.01)

(52) U.S. Cl.
CPC ..... *A41D 7/008* (2013.01); *A47K 10/02* (2013.01); *A41D 2200/20* (2013.01)

(58) Field of Classification Search
CPC ..... A41D 7/008; A41D 2200/20; A41D 2200/10; A41D 31/125; A47K 10/02
See application file for complete search history.

(56) References Cited

U.S. PATENT DOCUMENTS 459,106 A * 9/1891 Fifield ..... A41D 15/00 2/139
818,351 A * 4/1906 Clark ..... A41D 13/1236 2/114
1,243,206 A * 10/1917 Norman ..... A41D 7/00 2/84
1,467,718 A * 9/1923 Entrikin ..... A41D 7/008 D2/823
1,489,046 A * 4/1924 Thompson ..... A41B 9/08 2/269
1,497,685 A * 6/1924 Hoyme ..... A41D 7/008 2/48
2,707,282 A * 5/1955 Paterson ..... A41D 13/1236 2/221
2,712,133 A * 7/1955 Coleman ..... A61G 5/10 2/69
4,363,141 A * 12/1982 Doster ..... A47G 9/066 2/69.5
4,570,268 A * 2/1986 Freeman ..... A41D 13/1236 2/114
4,864,657 A * 9/1989 Lake ..... A41D 13/1236 2/114
4,995,115 A * 2/1991 Ellis ..... A41D 13/1236 2/125

(Continued)

*Primary Examiner* — Alissa L Hoey

(57) ABSTRACT

The present invention relates to a novel bathrobe towel device. The device is a modified hooded bathrobe made from bamboo cotton designed to be a more sustainable alternative to bath towels. The bathrobe towel device comprises a body component with two sleeve components, a hood component, and a belt component. Typically, the interior is constructed of a comfortable terry cloth material and the waffle-like material on the exterior is constructed using bamboo cotton. Accordingly, when the user needs to dry off, they will put the bathrobe device on, with the hood component up, to allow the absorptive bamboo cotton/terry cloth to dry the user off. In addition to drying the user off, the bathrobe device provides great coverage while leaving the bathroom.

4 Claims, 3 Drawing Sheets

(56) References Cited

U.S. PATENT DOCUMENTS 5,283,909 A * 2/1994 Hill ..... A47G 9/066 2/22
5,572,742 A * 11/1996 McFadden ..... A41D 13/1236 2/70
5,611,087 A * 3/1997 Adkins ..... A41D 13/1236 2/919
5,664,258 A * 9/1997 Harris ..... A41D 3/08 2/84
5,694,643 A * 12/1997 Fujiwara ..... A41D 7/008 2/114
5,697,102 A 12/1997 Benjamin
5,855,021 A * 1/1999 Somerville ..... A41D 1/04 2/84
6,367,082 B1 * 4/2002 Mina ..... D04H 1/4334 2/69
D560,330 S * 1/2008 Williams ..... D2/825
7,594,279 B2 * 9/2009 Roy ..... A41D 13/1236 2/114
9,089,174 B1 * 7/2015 Michaelis ..... A41D 13/0015
9,226,626 B2 * 1/2016 Sprague ..... A47K 10/02
9,756,882 B2 * 9/2017 Townsend ..... A41D 13/0012
9,949,515 B2 * 4/2018 Wilkins ..... A41C 3/0028
10,098,390 B2 10/2018 Ozbek
10,368,589 B2 * 8/2019 Read ..... A41D 31/02
10,813,396 B2 * 10/2020 Chrzanowska ..... A41D 7/008
11,441,246 B2 * 9/2022 Hozumi ..... D03D 1/0017
11,930,870 B2 * 3/2024 Turner ..... B32B 5/26
2007/0283481 A1 * 12/2007 Rawlings ..... A41D 7/008 2/114
2009/0025119 A1 * 1/2009 Nespor ..... A42B 1/049 2/202
2009/0055989 A1 * 3/2009 Chih ..... A41D 31/12 2/84
2009/0144878 A1 6/2009 Mina
2010/0069811 A1 3/2010 Poddar
2011/0305866 A1 * 12/2011 Stowe ..... A47K 10/02 428/100
2012/0096618 A1 * 4/2012 Mashkevich ..... A41D 7/008 2/69
2013/0125307 A1 * 5/2013 Margalit ..... A47K 10/02 5/417
2014/0123362 A1 5/2014 Seitz
2015/0173569 A1 * 6/2015 Griggs ..... A61F 7/08 15/209.1
2016/0192719 A1 7/2016 Chrzanowska
2017/0042268 A1 * 2/2017 Lessard ..... A42B 1/041
2018/0213866 A1 * 8/2018 Chien ..... A41D 15/005
2019/0297964 A1 * 10/2019 Brown ..... A45D 20/00
2020/0085120 A1 * 3/2020 Posacki ..... A47K 10/02
2021/0022415 A1 * 1/2021 Curry ..... A41B 1/22
2021/0054546 A1 * 2/2021 Grosfeld ..... D04B 1/04
2021/0329984 A1 * 10/2021 Arizmendi ..... A41D 27/20
2021/0345693 A1 * 11/2021 Nair ..... A41D 1/21
2021/0392978 A1 * 12/2021 King ..... A41D 15/00
2022/0022583 A1 * 1/2022 Royal ..... A42B 1/045
2022/0079255 A1 * 3/2022 Williams ..... A41D 27/20
2022/0117334 A1 * 4/2022 Hansen ..... A45C 9/00
2024/0008663 A1 * 1/2024 Melendez ..... A47G 9/1027
2024/0260684 A1 * 8/2024 Smith ..... A47K 10/02
2024/0292911 A1 * 9/2024 Ward ..... A41D 1/00
2024/0373952 A1 * 11/2024 Cook ..... A41D 1/06
2024/0398176 A1 * 12/2024 Harris ..... A47K 10/02

* cited by examiner

BATH ROBE TOWEL DEVICE

CROSS-REFERENCE TO RELATED APPLICATION

The present application claims priority to, and the benefit of, U.S. Provisional Application No. 63/444,075, which was filed on Feb. 8, 2023, and is incorporated herein by reference in its entirety.

FIELD OF THE INVENTION

The present invention relates generally to the field of bathrobe towel devices. More specifically, the present invention relates to an improved bathrobe capable of drying off the user after bathing. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in bathrobe towel devices. Generally, standard bath towels are designed to absorb excess water and moisture after bathing, but they are not designed for practicality when it comes to environment sustainability. These towels must be washed and dried, using considerable water and energy. Further, people may use multiple towels for their body and hair, which leads to significant laundry buildup.

Additionally, bathrobes are not meant to be used as a bath towel to dry off a user after bathing. Instead, a user typically utilizes at least one towel, sometimes two, to dry their body and hair and then utilizes the bathrobe. Accordingly, this practice is also not designed for practicality when it comes to environment sustainability.

Accordingly, a need remains for a more effective towel and bathrobe for drying off compared to standard towels and bathrobes. Further, a combination bathrobe and bath towel is necessary to maintain environmental sustainability, reducing the number of laundry loads required when compared to standard bath towels.

Therefore, there exists a long-felt need in the art for a bathrobe towel device that provides users with an improved bathrobe capable of drying off the user after bathing. There is also a long-felt need in the art for a bathrobe towel device that features a comfortable terry cloth material on the interior and waffle-like material on the exterior. Further, there is a long-felt need in the art for a bathrobe towel device that features a bathrobe constructed using bamboo cotton, to help facilitate absorption. Moreover, there is a long-felt need in the art for a device that includes a slit up the side to the knee to accommodate wheelchair users, enabling them to wear the robe comfortably while sitting in their chair. Further, there is a long-felt need in the art for a bathrobe towel device that offers a more effective towel for drying off compared to standard towels. Finally, there is a long-felt need in the art for a bathrobe towel device that maintains environmental sustainability, reducing the number of laundry loads required when compared to standard bath towels.

The subject matter disclosed and claimed herein, in one embodiment thereof, comprises a bathrobe towel device. The device is a modified hooded bathrobe made from bamboo cotton designed to be a more sustainable alternative to bath towels. The bathrobe towel device comprises a body component with two sleeve components, a hood component, and a belt component. The bathrobe towel device utilizes a viscous combination of materials, terry cloth, bamboo, cotton, and hemp for construction, and utilizes both sleek and waffle-style materials. Typically, the interior is constructed of a comfortable terry cloth material and the waffle-like material on the exterior is constructed using bamboo cotton. Accordingly, when the user needs to dry off, they will put the bathrobe device on with the hood component up to allow the absorptive bamboo cotton/terry cloth to dry the user off. In addition to drying the user off, the bathrobe device provides great coverage while leaving the bathroom.

Furthermore, it is designed as a hooded, head to floor bathrobe, with two ties sewn in at the waistline that act as a belt component to keep the bathrobe device secured to a user's body. A slit on the side rides up to the knee for accommodating those sitting in a wheelchair. Further, the hood component is designed for multipurpose use, as it will be used as a hair towel, a face towel, or to hang on a hook. The bathrobe device may be available in various sizes, colors, and styles.

In this manner, the bathrobe towel device of the present invention accomplishes all of the foregoing objectives and provides users with a device that efficiently and easily dries off a user, without use of a bath towel. The device is a combination bathrobe and towel that is capable of drying off a user after bathing. The device can be manufactured of a bamboo cotton or terry cloth to effectively dry a user.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a bathrobe towel device. The device is a modified hooded bathrobe made from bamboo cotton designed to be a more sustainable alternative to bath towels. The bathrobe towel device comprises a body component with two sleeve components, a hood component, and a belt component. Accordingly, when the user needs to dry off, they will put the bathrobe device on with the hood component up, to allow the absorptive bamboo cotton/terry cloth to dry the user off. In addition to drying the user off, the bathrobe device provides great coverage while leaving the bathroom.

In one embodiment, the bathrobe towel device is a modified bathrobe made from super absorptive materials to allow for a more effective combination bathrobe and towel device, compared to standard towels. Typically, the bathrobe is also called a dressing gown, a morning gown, a housecoat, or a robe. Preferably, the bathrobe device is made from a combination of viscous materials, such as terry cloth, bamboo, cotton, microfiber, hemp, etc., and/or other absorbent textile materials or combinations thereof, and utilizes both sleek and waffle-style materials. Typically, the bathrobe towel device is constructed of a soft, terry cloth material on the interior, which contacts a user's body and absorbs water and moisture. The bathroom towel device also comprises an exterior constructed of a waffle-like material of bamboo cotton or other suitable material which also helps to facilitate absorption. More preferably, the bathrobe device is configured to be worn while the user's body is wet, thereby serving both as a towel and an informal garment. The bathrobe towel device prevents a user from first having to dry themselves with a towel before putting on the bathrobe device. Instead, users utilize the bathrobe towel device as both a towel and a bathrobe. Thus, the device maintains environmental sustainability by reducing the number of laundry loads required when compared to standard bath towels.

Preferably, the bathrobe towel device, in use, forms a loose fitting, open-fronted garment that is closed with a belt component (fabric belt) threaded through loops attached to the waistline (waist area) of the bathrobe device. In another embodiment, the belt component comprises two ties sewn in at the waistline that allow the device to be adjustable and secures the device to a user's body. Furthermore, the bathrobe towel device is typically a hooded, head to floor bathrobe device, but can be any suitable length as is known in the art, depending on the needs and/or wants of a user.

In another embodiment, the bathrobe towel device comprises a body component with two sleeve components, a neck opening (or neckline), and a hood component. Furthermore, the bathrobe device may include a collar positioned around the neckline of the garment. The collar may be any suitable type and/or shape or may include no collar, such as: a shawl collar (this collar closes about the neck just like a shawl), a kimono collar (a kimono style robe has no collar per se, and may provide more comfort to the user in warmer weather), and/or a hooded collar (a hood component is sewn into the neckline, which can be worn over the head to keep the head warm and help dry wet hair). Generally, the collar is a part of the bathrobe device that encompasses the neckline of the bathrobe device, so as to fold or roll over the neckline of the bathrobe device.

Additionally, the bathrobe device also comprises a yoke section that surrounds (at least in part) the neck opening/neckline configured to receive the neck of a user. Preferably, the yoke section includes a shaped pattern piece that forms part of the bathrobe device and is fitted around the neck and shoulders. Preferably, the yoke section includes a horizontally aligned piece of fabric positioned proximate to the shoulders (of the user). Further, the yoke section extends between each of the armholes (defined by the bathrobe device) and the collar (i.e., extending from shoulder to shoulder).

In one embodiment, the bathrobe towel device comprises a set of armholes positioned on opposing sides of the body component. The armholes comprise a sleeve component secured to the opening, typically sewn thereto but could be any suitable securing means as is known in the art. The sleeve components can be long, short, or mid-length sleeve components, depending on the wants and/or needs of a user. In one embodiment, the sleeve components also comprise a cuff (i.e., a fold or band serving as a trimming or finish) positioned at the bottom of the sleeve components and affixed thereto.

In one embodiment, the body component comprises a front left chest area which extends below the yoke section. The front left chest area is configured to be positioned on the front left chest of the user once the user wears the bathrobe. Further, the body component comprises a front right chest area which extends below the yoke section. The front right chest area is spaced apart from the front left chest area. The front right chest area is configured to be positioned on the front right chest of the user when the user wears the bathrobe. Additionally, a vertically-extending placket extends below the yoke section. The vertically-extending placket physically separates the front left chest area and the front right chest area into two sides. Typically, the vertically-extending placket may be separated from neck to foot in a parting line which defines an opening, to allow a user to put on the bathrobe device like a coat (i.e., placing an arm into each sleeve component). Thus, the vertically-extending placket is configured to allow the bathrobe device to be put on or removed by the user. The vertically-extending placket may include one or more layers of fabric (to give support and strength to the placket fabric because the vertically-extending placket may be subjected to stress when the bathrobe device is worn). Further, the two sides of the vertically-extending placket may overlap, especially when the bathrobe device is secured around a user's waist via the belt component.

In one embodiment, the body component and collar comprise a hood component. Preferably, the hood component is used for drying the hair and face of a user without the need for extra towels (i.e., towels that are separate from the bathrobe device). Preferably, the hood component is manufactured of an absorbent fabric used for drying or wiping the head, the face, and the hair (that is, the upper parts) of the user. The hood component is configured to draw moisture through direct contact by using a blotting or a rubbing motion. The hood component may be made from cotton, rayon, bamboo, non-woven fibers, and other materials (and any equivalent thereof). Once the bathrobe device is worn by the user, the user may grasp the hood component (with the user's hand) and use it for drying the head, the face, the neck, and/or the hair of the user.

In one embodiment, the body component comprises a slit on the side which rides up to the user's knee or can be any suitable length as is known in the art, depending on the needs and/or wants of a user. In another embodiment, the body component comprises two slits, each on an opposing side of the body component. The slits allow the user more mobility while wearing the bathrobe device. Further, the slits also allow the device to accommodate those sitting in a wheelchair or other mobility device.

In addition, the bathrobe device may reduce the need for separate bath towels that match the style of the bathrobe device. For instance, many users use more towels than they actually need, such as a hair towel, a face towel, and/or a body towel. By having the bathrobe device be a towel, fewer towels may be utilized or may require cleaning, thereby lowering cleaning costs and maintaining environmental sustainability. The bathrobe device also helps reduce the cleaning and disinfecting expenses, not to mention less environmentally harmful waste, by using less detergents for cleaning towels and robes, etc.

Furthermore, in relatively larger families with limited bathroom space, less hooks may be needed if the device is utilized. For example, a family of four may have their face towels, head towels, and bathrobes hung on four separate hooks, and no additional hooks may be needed. After washing hands, the family members may use the bathrobe device. If the family has a guest staying over, the bathrobe device may be sufficient for the needs of the guest (i.e., for drying the body, the head, the hair, the face, and/or the hands, when needed as such).

In another embodiment, the bathrobe towel device is multi-layered and includes at least one bottom layer and at least one upper layer.

Additionally, the bathrobe towel device is also available in multiple sizes and styles to accommodate any type of user or to match any type of bathroom.

In one embodiment, the bathrobe towel device is manufactured of bamboo, terry cloth, hemp, fleece, cotton, polyester, blended fabrics, or other suitable materials as is known in the art. The bathrobe towel device can be manufactured in different thicknesses and weights, depending on the wants and/or needs of a user.

Also, the bathrobe towel device may be manufactured in different styles, patterns, and designs, and can include suitable ornamental designs and decorations, depending on the needs and/or wants of a user and/or the décor of the user's bathroom. Further, the outer edges may also include additional suitable material, such as fabric, embroidery, ribbons, lace, edging, seams, or other desirable material in order to further enhance the appearance of the bathrobe device and also to prevent tearing and fraying which may result from repeated use and washing.

In yet another embodiment, the bathrobe towel device comprises a plurality of indicia.

In yet another embodiment, a method of drying off a user after bathing while maintaining environmental sustainability by reducing the number of laundry loads required is disclosed. The method includes the steps of providing a bathrobe towel device comprising a body component with two sleeve components, a hood component, and a belt component. The method also comprises putting on the bathrobe device after bathing. Further, the method comprises allowing the absorptive materials of the bathrobe device to dry the user. Finally, the method comprises utilizing the hood component to dry a user's hair and face.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1A:
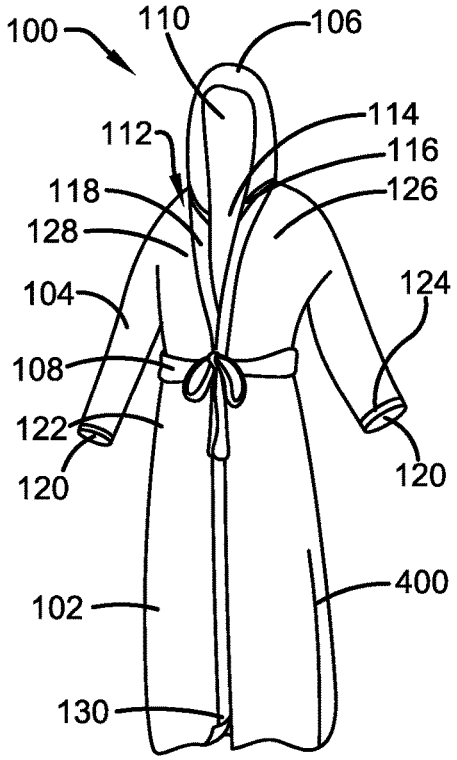
FIGS. 1A-B illustrate a front perspective view of one embodiment of the bathrobe towel device of the present invention showing the material the device is made from in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a bathrobe towel device that provides users with an improved bathrobe capable of drying off the user after bathing. There is also a long-felt need in the art for a bathrobe towel device that features a comfortable terry cloth material on the interior and a waffle-like material on the exterior. Further, there is a long-felt need in the art for a bathrobe towel device that features a bathrobe constructed using bamboo cotton to help facilitate absorption. Moreover, there is a long-felt need in the art for a device that includes a slit up the side to the knee to accommodate wheelchair users, enabling them to wear the robe comfortably while sitting in their chair. Further, there is a long-felt need in the art for a bathrobe towel device that offers a more effective towel for drying off compared to standard towels. Finally, there is a long-felt need in the art for a bathrobe towel device that maintains environmental sustainability, reducing the number of laundry loads required when compared to standard bath towels.

The present invention, in one exemplary embodiment, is a novel bathrobe towel device. The device is a modified hooded bathrobe made from bamboo cotton designed to be a more sustainable alternative to bath towels. The bathrobe towel device comprises a body component with two sleeve components, a hood component, and a belt component. Typically, the interior is constructed of a comfortable terry cloth material and the waffle-like material on the exterior is constructed using bamboo cotton. Accordingly, when the user needs to dry off, they will put the bathrobe device on with the hood component up to allow the absorptive bamboo cotton/terry cloth to dry off. In addition to drying the user off, the bathrobe device provides great coverage while leaving the bathroom. The present invention also includes a novel method of drying off a user after bathing while maintaining environmental sustainability by reducing the number of laundry loads required. The method includes the steps of providing a bathrobe towel device comprising a body component with two sleeve components, a hood component, and a belt component. The method also comprises putting on the bathrobe device after bathing. Further, the method comprises allowing the absorptive materials of the bathrobe device to dry the user. Finally, the method comprises utilizing the hood component to dry a user's hair and face.

Figure 1B:
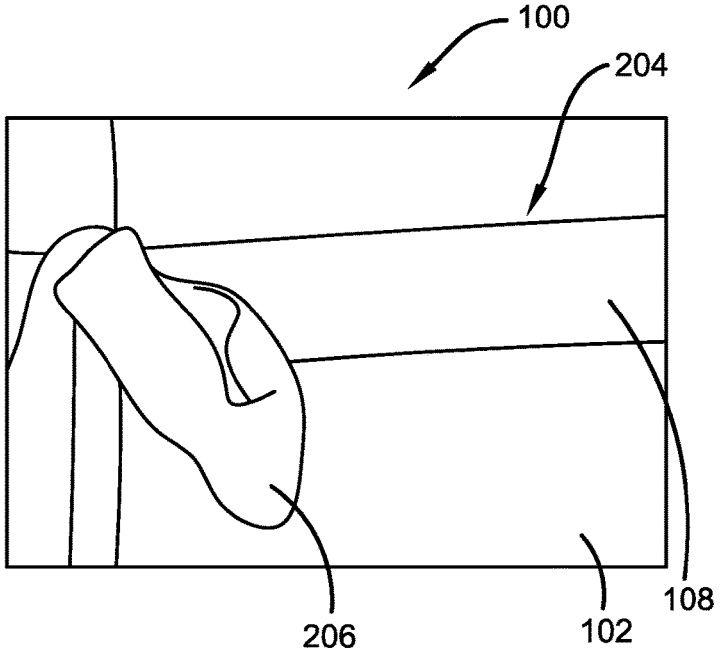

Referring initially to the drawings, FIGS. 1A-B illustrate a perspective view of one embodiment of the bathrobe towel device 100 of the present invention. In the present embodiment, the bathrobe towel device 100 is an improved bathrobe towel device 100 that maintains environmental sustainability, reducing the number of laundry loads required when compared to standard bath towels. Specifically, the bathrobe towel device 100 is a modified hooded bathrobe made from bamboo cotton or other suitable absorptive materials, designed to be a more sustainable alternative to bath towels. The bathrobe towel device 100 comprises a body component 102 with two sleeve components 104, a hood component 106, and a belt component 108. Accordingly, when the user 200 needs to dry off, they will put the bathrobe device 100 on with the hood component 106 up to allow the absorptive bamboo cotton, terry cloth, etc., or other absorptive material, to dry the user 200 off. In addition to drying the user 200 off, the bathrobe device 100 provides great coverage while leaving the bathroom 202.

Generally, the bathrobe towel device 100 is a modified bathrobe made from super absorptive materials to allow for a more effective combination bathrobe and towel device 100, compared to standard towels. Typically, the bathrobe is also called a dressing gown, a morning gown, a housecoat, or a robe, etc. Preferably, the bathrobe device 100 is made from a combination of viscous materials, such as terry cloth, bamboo, cotton, microfiber, and hemp, etc., and/or other absorbent textile materials or combinations thereof, as well as utilizing both sleek and waffle-style materials. Typically, the bathrobe towel device 100 is constructed of a soft, terry cloth material on the interior 110, which contacts a user's body and absorbs water and moisture. The bathroom towel device 100 also comprises an exterior 112 constructed of a waffle-like material of bamboo cotton or other suitable material which also helps to facilitate absorption. More preferably, the bathrobe device 100 is configured to be worn while the user's body is wet, thereby serving both as a towel and an informal garment. The bathrobe towel device 100 prevents a user 200 from first having to dry themselves with a towel before putting on the bathrobe device 100. Instead, users 200 utilize the bathrobe towel device 100 as both a towel and a bathrobe. Thus, the device 100 maintains environmental sustainability by reducing the number of laundry loads required when compared to standard bath towels.

Furthermore, the bathrobe towel device 100 comprises a body component 102 with two sleeve components 104, a neck opening (or neckline) 114, and a hood component 106. Furthermore, the bathrobe device 100 may include a collar 116 positioned around the neckline 114 of the garment. The collar 116 has any suitable type and/or shape or the device 100 may include no collar 116. For example, some types of collars 116 can include: a shawl collar (this collar closes about the neck just like a shawl), a kimono collar (a kimono style robe has no collar per se, and may provide more comfort to the user in warmer weather), and/or a hooded collar (a hood component 106 is sewn into the neckline 114, which can be worn over the head to keep the head warm and help dry wet hair). Generally, the collar 116 is a part of the bathrobe device 100 that encompasses the neckline 114 of the bathrobe device 100, so as to fold or roll over the neckline 114 of the bathrobe device 100.

Additionally, the bathrobe device 100 also comprises a yoke section 118 that surrounds (at least in part) the neck opening/neckline 114 configured to receive the neck of a user 200. Preferably, the yoke section 118 includes a shaped pattern piece that forms part of the bathrobe device 100 and is fitted around the neck and shoulders of a user 200. Preferably, the yoke section 118 includes a horizontally aligned piece of fabric positioned proximate to the shoulders (of the user 200). Further, the yoke section 118 extends between each of the armholes 120 and sleeve components 104 defined by the bathrobe device 100 and the collar 116 (i.e., extending from shoulder to shoulder).

Typically, the bathrobe towel device 100 comprises a set of armholes 120 positioned on opposing sides 122 of the body component 102. The armholes 120 comprise a sleeve component 104 secured to the opening 120, typically sewn thereto but could be any suitable securing means as is known in the art. The sleeve components 104 can be long, short, or mid-length sleeve components, depending on the wants and/or needs of a user. In one embodiment, the sleeve components 104 also comprise a cuff 124 (i.e., a fold or band serving as a trimming or finish) positioned at the bottom of the sleeve components 104 and affixed thereto.

Furthermore, the body component 102 comprises a front left chest area 126 which extends below the yoke section 118. The front left chest area 126 is configured to be positioned on the front left chest of the user 200 when the user 200 wears the bathrobe device 100. Further, the body component 102 comprises a front right chest area 128 which extends below the yoke section 118. The front right chest area 128 is spaced apart from the front left chest area 126. The front right chest area 128 is configured to be positioned on the front right chest of the user 200 once the user 200 wears the bathrobe device 100. Additionally, a vertically-extending placket 130 extends below the yoke section 118. The vertically-extending placket 130 physically separates the front left chest area 126 and the front right chest area 128 into two sides. Typically, the vertically-extending placket 130 may be separated from neck to foot in a parting line which defines an opening 132 to allow a user 200 to put on the bathrobe device 100 like a coat (i.e., placing an arm into each sleeve component 104). Thus, the vertically-extending placket 130 is configured to allow the bathrobe device 100 to be put on or removed by the user 200. The vertically-extending placket 130 may include one or more layers of fabric (to give support and strength to the placket fabric because the vertically-extending placket 130 may be subjected to stress when the bathrobe device 100 is worn). Further, the two sides 126 and 128 of the vertically-extending placket 130 may overlap, especially when the bathrobe device 100 is secured around a user's waist 204 via the belt component 108.

Figure 2:
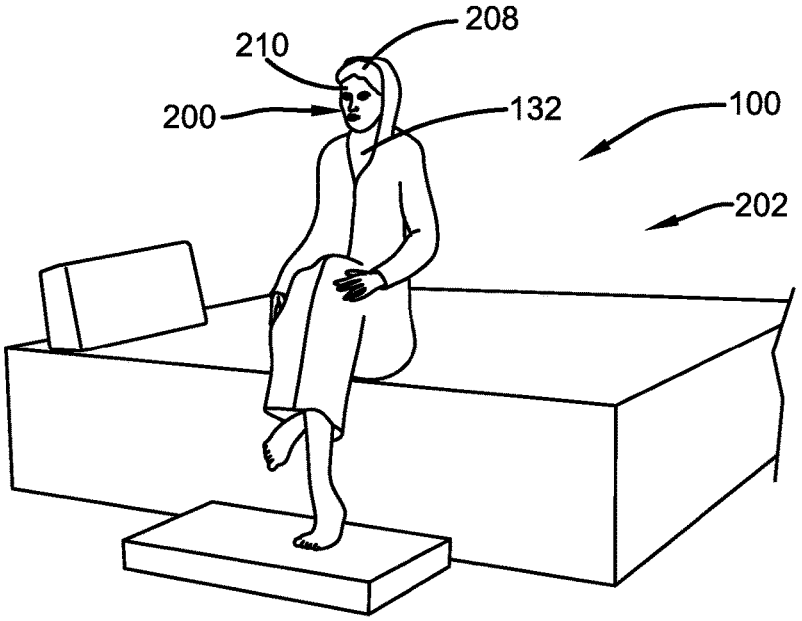
FIG. 2 illustrates a perspective view of one embodiment of the bathrobe towel device of the present invention showing the device being worn after a bath in accordance with the disclosed architecture.
Figure 3:
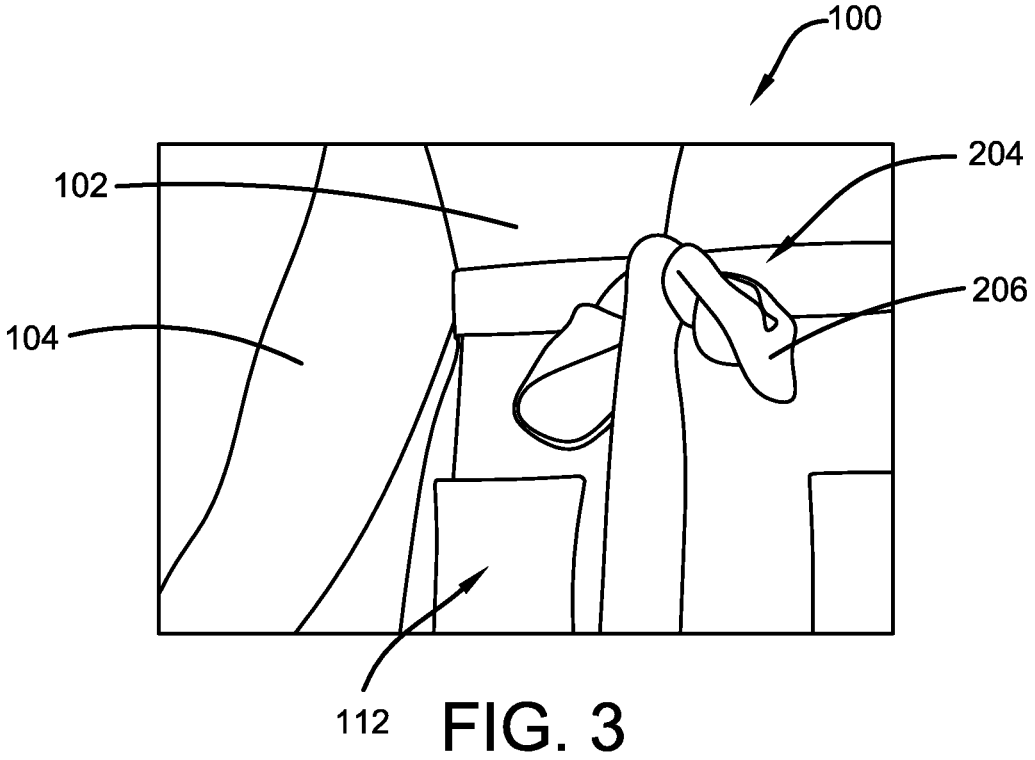
FIG. 3 illustrates a perspective view of one embodiment of the bathrobe towel device of the present invention showing the adjustable waistband in accordance with the disclosed architecture.

As shown in FIGS. 2-3, the bathrobe towel device 100, in use, forms a loose fitting, open-fronted garment that is closed with a belt component 108 (fabric belt) threaded through loops attached to the waistline (waist area 204) of the bathrobe device 100. In another embodiment, the belt component 108 comprises two ties 206 sewn in at the waistline 204 that allow the device 100 to be adjustable and secure the device 100 to a user's body. Furthermore, the bathrobe towel device 100 is typically a hooded, head to floor bathrobe device 100, but can be any suitable length as is known in the art, depending on the needs and/or wants of a user 200.

Furthermore, the body component 102 and collar 116 comprise a hood component 106. Preferably, the hood component 106 is used for drying the hair 208 and face 210 of a user 200, without the need for extra towels (i.e., towels that are separate from the bathrobe device 100). Preferably, the hood component 106 is manufactured of an absorbent fabric used for drying or wiping the head, the face 210, and the hair 208 (that is, the upper parts) of the user 200. The hood component 106 is configured to draw moisture through direct contact by using a blotting or a rubbing motion. The hood component 106 may be made from cotton, rayon, bamboo, non-woven fibers, and other materials (and any equivalent thereof). Once the bathrobe device 100 is worn by the user 200, the user 200 may grasp the hood component 106 (with the user's hand) and use it for drying the head, the face 210, the neck, and/or the hair 208 of the user 200.

Figure 4:
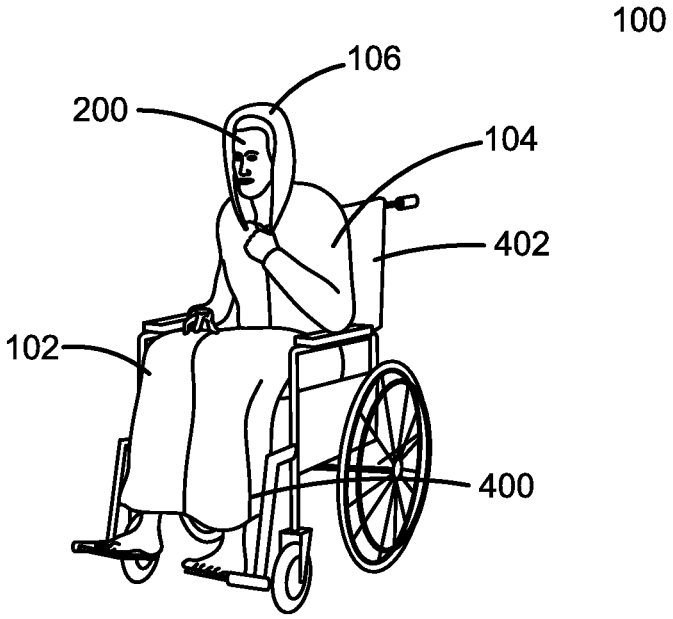
FIG. 4 illustrates a perspective view of one embodiment of the bathrobe towel device of the present invention showing the device being worn in a wheelchair in accordance with the disclosed architecture.

As shown in FIG. 4, the body component 102 comprises a slit 400 on the side 122 which rides up to the user's knee or can be any suitable length as is known in the art, depending on the needs and/or wants of a user 200. In another embodiment, the body component 102 comprises two slits 400, each on an opposing side 122 of the body component 102. The slits 400 allow the user 200 more mobility while wearing the bathrobe device 100. Further, the slits 400 also allow the device 100 to accommodate those sitting in a wheelchair 402 or other mobility devices.

Figure 5:
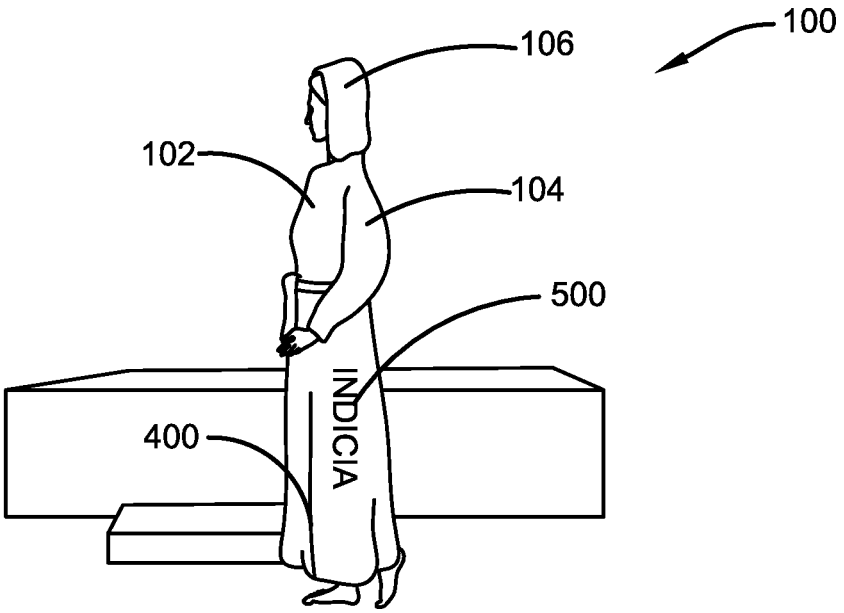
FIG. 5 illustrates a side perspective view of one embodiment of the bathrobe towel device of the present invention showing the device in use in accordance with the disclosed architecture.

As shown in FIG. 5, the bathrobe device 100 may reduce the need for separate bath towels that match the style of the bathrobe device 100. For instance, many users 200 use more towels than they actually need, such as a hair towel, a face towel, and/or a body towel. By having the bathrobe device 100 be also a towel, fewer towels may be utilized or may require cleaning, thereby lowering cleaning costs and maintaining environmental sustainability. The bathrobe device 100 also helps reduce the cleaning and disinfecting expenses, not to mention less environmentally harmful waste, by using less detergents for cleaning towels and robes, etc.

Furthermore, in relatively larger families with limited bathroom space, less hooks may be needed if the device 100 is utilized. For example, a family of four may have their face towels, head towels, and bathrobes hung on four separate hooks, and no additional hooks may be needed. After washing hands, the family members may use the bathrobe device 100. If the family has a guest staying over, the bathrobe device 100 may be sufficient for the needs of the guest (i.e., for drying the body, the head, the hair, the face, and/or the hands, when needed as such).

In another embodiment, the bathrobe towel device is multi-layered and includes at least one bottom layer and at least one upper layer (not shown). Any suitable number of layers can be utilized as is known in the art, depending on the needs and/or wants of a user. Additionally, the bathrobe towel device 100 is also available in multiple sizes and styles to accommodate any type of user 200 or to match any type of bathroom 202.

Additionally, in one embodiment, the bathrobe towel device 100 is manufactured of bamboo, terry cloth, hemp, fleece, cotton, polyester, blended fabrics, or other suitable materials as is known in the art. The bathrobe towel device 100 can be manufactured in different thicknesses and weights, depending on the wants and/or needs of a user 200.

Also, the bathrobe towel device 100 may be manufactured in different styles, patterns, and designs, and can include suitable ornamental designs and decorations, depending on the needs and/or wants of a user 200 and/or the décor of the user's bathroom 202. Further, the outer edges may also include additional suitable material, such as fabric, embroidery, ribbons, lace, edging, seams, or other desirable material in order to further enhance the appearance of the bathrobe device 100 and also to prevent tearing and fraying which may result from repeated use and washing.

In yet another embodiment, the bathrobe towel device 100 comprises a plurality of indicia 500. The body component 102 of the device 100 may include advertising, trademark, other letters, designs, or characters, printed, painted, stamped, or integrated into the body component 102, or any other indicia 500 as is known in the art. Specifically, any suitable indicia 500 as is known in the art can be included, such as, but not limited to, patterns, logos, emblems, images, symbols, designs, letters, words, characters, animals, advertisements, brands, etc., that may or may not be bathroom, towel, or brand related.

Figure 6:
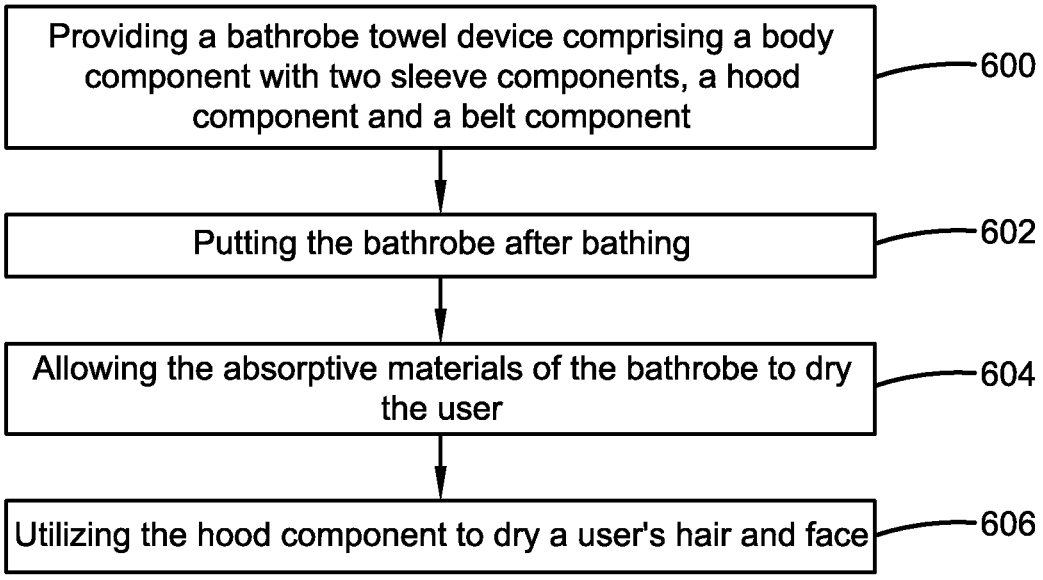
FIG. 6 illustrates a flowchart showing the method of drying off a user after bathing while maintaining environmental sustainability by reducing the number of laundry loads required in accordance with the disclosed architecture.

FIG. 6 illustrates a flowchart of the method of drying off a user after bathing while maintaining environmental sustainability by reducing the number of laundry loads required. The method includes the steps of at 600, providing a bathrobe towel device comprising a body component with two sleeve components, a hood component, and a belt component. The method also comprises at 602, putting on the bathrobe device after bathing. Further, the method comprises at 604, allowing the absorptive materials of the bathrobe device to dry the user. Finally, the method comprises at 606, utilizing the hood component to dry a user's hair and face.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "bathrobe towel device", "bathrobe device", and "device" are interchangeable and refer to the bathrobe towel device 100 of the present invention.

Notwithstanding the foregoing, the bathrobe towel device 100 of the present invention can be of any suitable size and configuration as is known in the art without affecting the overall concept of the invention, provided that it accomplishes the above-stated objectives. One of ordinary skill in the art will appreciate that the bathrobe towel device 100 as shown in FIGS. 1-6 are for illustrative purposes only, and that many other sizes and shapes of the bathrobe towel device 100 are well within the scope of the present disclosure. Although the dimensions of the bathrobe towel device 100 are important design parameters for user convenience, the bathrobe towel device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A bathrobe towel device that is a more sustainable alternative to bath towels, the bathrobe towel device comprising:

a body component comprising a neck opening, a collar, and a hood component;

two sleeve components, wherein the two sleeve components comprise a first sleeve and a second sleeve; the first sleeve and the second sleeve each have a band component affixed thereto; and a belt component;

wherein the body component is manufactured from an absorptive material that is capable of absorbing water and moisture from a user, wherein an interior surface of the absorptive material is a terry cloth fabric, and wherein an exterior surface of the absorptive material is a waffle fabric;

wherein the body component comprises a set of armholes positioned on opposing sides of the body component, wherein the sleeve components are secured to the armholes; wherein the body component comprises a yoke section that surrounds the neck opening and includes a horizontally aligned piece of fabric which extends between each of the sleeve components; wherein the body component comprises a front left chest area and a front right chest area which extends below the yoke section; wherein the body component comprises a vertically-extending placket that extends below the yoke section to a bottom edge of the body component and physically separates the front left chest area and the front right chest area and is configured to allow a user to put the bathrobe towel device on;

wherein the hood component is attached to the collar and is configured for drying a user's hair, head and face;

wherein the body component further comprises a pair of slits, the pair of slits comprise a first slit and a second slit; wherein the first slit is located on a right side of the body component between the front right chest area and a back area of the body component, and wherein the second slit is located on a left side of the body component between the front left chest area and the back area of the body component; wherein the first slit and the second slit extend partially up the body component from the bottom edge of the body component; and wherein the belt component comprises a first tie and a second tie; wherein the first tie and the second tie are each sewn at a waistline of the body component.

2. The bathrobe towel device of claim 1 further comprising a plurality of indicia.

3. A bathrobe towel device that is a more sustainable alternative to bath towels, the bathrobe towel device comprising:

a body component comprising a neck opening, a collar, and a hood component;

two sleeve components, wherein the two sleeve components comprise a first sleeve and a second sleeve; the first sleeve and the second sleeve each have a band component affixed thereto; and a belt component;

wherein the body component is manufactured from an absorptive material that is capable of absorbing water and moisture from a user, wherein an interior surface of the absorptive material comprises loops of a terry cloth fabric, and wherein an exterior surface of the absorptive material comprises bamboo or hemp fabric that is constructed to create a smooth texture;

wherein the body component comprises a set of armholes positioned on opposing sides of the body component, wherein the sleeve components are secured to the armholes; wherein the body component comprises a yoke section that surrounds the neck opening and includes a horizontally aligned piece of fabric which extends between each of the sleeve components; wherein the body component comprises a front left chest area and a front right chest area which extends below the yoke section; wherein the body component comprises a vertically-extending placket that extends below the yoke section to a bottom edge of the body component and physically separates the front left chest area and the front right chest area and is configured to allow a user to put the bathrobe towel device on;

wherein the hood component is attached to the collar and is configured for drying a user's hair, head and face;

wherein the body component further comprises a pair of slits, the pair of slits comprise a first slit and a second slit; wherein the first slit is located on a right side of the body component between the front right chest area and a back area of the body component, and wherein the second slit is located on a left side of the body component between the front left chest area and the back area of the body component; wherein the first slit and the second slit extend partially up the body component from the bottom edge of the body component; and wherein the belt component comprises a first tie and a second tie; wherein the first tie and the second tie are each sewn at a waistline of the body component.

4. The bathrobe towel device of claim 3 further comprising a plurality of indicia.

* * * * *